US005184962A

United States Patent [19]

Noschese

[11] Patent Number: 5,184,962

[45] Date of Patent: Feb. 9, 1993

[54] ELECTRICAL SPRING CONTACT

[75] Inventor: Rocco J. Noschese, Wilton, Conn.

[73] Assignee: Burndy Corporation, Norwalk, Conn.

[21] Appl. No.: 803,002

[22] Filed: Dec. 5, 1991

[51] Int. Cl.[5] ..... H01R 9/09

[52] U.S. Cl. ..... 439/66; 439/591

[58] Field of Search ..... 439/66, 91, 591, 71

[56] References Cited

U.S. PATENT DOCUMENTS

| | | | |
|---|---|---|---|
| 3,258,736 | 6/1966 | Crawford et al. | 339/252 |
| 3,795,884 | 3/1974 | Kotaka | 339/17 LM |
| 4,029,375 | 6/1977 | Gabrielian | 339/17 M |
| 4,100,856 | 7/1978 | Ziemba | 102/106 |
| 4,161,346 | 7/1979 | Cherian et al. | 339/17 M |
| 4,199,209 | 4/1980 | Cherian et al. | 339/59 M |
| 4,505,529 | 3/1985 | Barkus | 339/17 M |
| 4,620,761 | 11/1986 | Smith et al. | 339/75 MP |
| 4,752,231 | 6/1988 | Olsson | 439/66 |
| 4,778,404 | 10/1988 | Pass | 439/387 |
| 4,961,709 | 10/1990 | Noschese | 439/66 |
| 5,030,109 | 7/1991 | Dery | 439/66 |
| 5,061,191 | 10/1991 | Casciotti et al. | 439/66 |

*Primary Examiner*—Neil Abrams

*Attorney, Agent, or Firm*—Perman & Green

[57] ABSTRACT

An electrical contact has a main body section, a top contact section, and a bottom contact section. The main body section has a general ring shape with a general diagonally shaped open area extending from a top of the main body section to a bottom of the main body section. The top contact section extends from the top of the main body section and the bottom contact section extends from the bottom of the main body section.

16 Claims, 1 Drawing Sheet

ELECTRICAL SPRING CONTACT

BACKGROUND OF THE INVENTION

1. Field of the Invention

The present invention generally relates to electrical spring contacts and, in particular, to a new type of spring contact and a method of manufacturing the same.

2. Prior Art

U.S. Pat. No. 4,961,709 to Noschese discloses a vertical action spring contact made from a one-piece blank that is wound into a spiral. The spring contact can be mounted in a hole in a matrix block and can be used to transmit signals or grounds between parallel circuit boards. U.S. Pat. No. 5,030,109 to Dery discloses a coiled spring contact that is laid on its side. U.S. Pat. Nos. 4,029,375; 4,199,209; 4,620,761; 3,795,884; 3,258,736; 4,778,404; 4,161,346; 4,505,529; and 4,752,231 disclose other types of electrical spring contacts.

Various problems exist with spring contacts in the prior art. One problem is the lack of ease of manufacture of the contacts and, assembly of the contacts with a housing. Some contacts are difficult to manufacture, especially in relatively small sizes. Another problem is that it is often desirable to have a contact with a relatively short path between contact surfaces, especially when intended to be used in connecting electronic devices. Prior art spring contacts did not always provide a relatively short path between contact surfaces.

It is an objective of the present invention to overcome problems in the prior art as well as provide additional features and advantages.

SUMMARY OF THE INVENTION

The foregoing problems are overcome and other advantages are provided by a new and improved electrical spring contact.

In accordance with one embodiment of the present invention, an electrical contact is provided. The contact comprises a main body section, a top contact section, and a bottom contact section. The main body section has a general ring shape with a general diagonally shaped open area extending from a top of the main body section to a bottom of the main body section. The main body section is substantially uniformly solid except for its center and the general diagonally shaped open area. The top contact section extends from the top of the main body section proximate the general diagonally shaped open area. The bottom contact section extends from the bottom of the main body section proximate the general diagonally shaped open area.

In accordance with one method of the present invention, a method of manufacturing an electrical contact is provided. The method comprises steps of cutting a blank from a sheet of metal, the blank having a main body section with a general parallelogram shape and contact sections extending from opposite ends of the main body section; and deforming the main body section to form a general ring shape with the opposite ends of the main body section facing each other and having an open area therebetween.

In accordance with another embodiment of the present invention, an electrical connector is provided. The connector comprises a housing, and contacts. The housing has a plurality of contact receiving apertures extending therethrough. The contacts are located in the contact receiving apertures. The contacts have a top contact section, a bottom contact section, and a main body section. The main body section has a general coil shape with a single loop.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
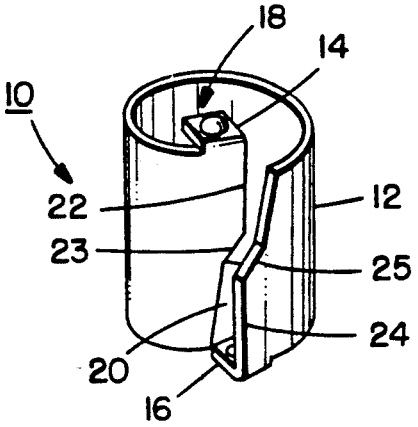
FIG. 1 is a perspective view of an electrical spring contact incorporating features of the present invention.

Referring to FIG. 1, there is shown a perspective view of an electrical spring contact 10 incorporating features of the present invention. Although the present invention will be described with reference to the embodiment shown in the drawings, it should be understood that the present invention can be embodied in various different types and kinds of alternate embodiments. In addition, any suitable size, shape and type of elements or materials could be used.

Figure 3:
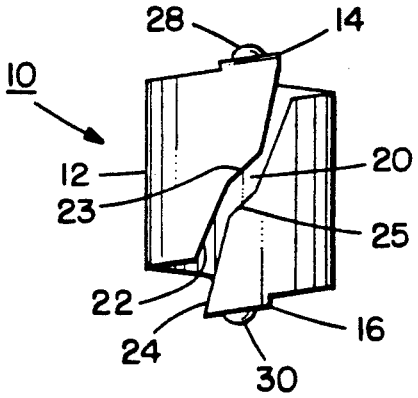
FIG. 3 is a plan front view of the contact shown in FIG. 1.

Referring to FIGS. 1 and 3, the contact 10 generally comprises a main body section 12, a top contact section 14, and a bottom contact section 16. The contact 10 is comprised of a sheet of metal that is cut and stamped by progressive dies to form the annular or ring-like shape shown. The main body section 12 is substantially uniformly solid except for its center aperture 18 and a generally diagonally shaped open area 20. The open area 20 is formed by a gap between two ends 22 and 24 of the main body section 12. In the embodiment shown, the contact 10 is formed from a flat blank 26 (see FIG. 5) having a general parallelogram shape. Thus, when the blank 26 is deformed into the contact 10, the general diagonally shaped open area 20 is able to be formed. In the embodiment shown, the open area 20 is not an exact diagonal shape. The two ends 22 and 24 have a stepped section 23 and 25, respectively. However, the ends 22 and 24 may have uniform shapes or any suitable type of irregular shape may be provided, or a combination of the two. The open area 20 could also have a general zig-zag shape. In the embodiment shown, the diagonally shaped open area 20 extends along about 45° of the main body section circumference. Although the open area 20 has been described as generally diagonally shaped, it should be noted that, although it appears generally diagonal from a plan front view as seen in FIG. 3, it is actually along a general helical path. Therefore, as used herein, the term diagonal is intended to include helical. One of the features of the present invention is that the open area 20 is limited to less than 360° of a helical path as further understood below The top contact section 14, in the embodiment shown, extends from the top of the main body section 12 generally perpendicular to the center axis of the contact 10. The bottom contact section 16 extends from the bottom of the main body section 12 generally perpendicular to the center axis of the contact 10. The top and bottom contact sections 14 and 16 are generally located in a line parallel to the center axis of the contact 10. However, in an alternate embodiment, the contact sections 14 and 16 need not be generally located in a line parallel to the center axis of the contact. Although the contact sections 14 and 16 are shown as extending towards the center axis of the contact 10, in an alternate embodiment one or both may extend outwards from the center axis of the contact 10. In the embodiment shown, both contact sections 14 and 16 have contact surfaces 28 and 30. The top contact surface 28 extends up and the bottom contact surface 30 extends down. In the embodiment shown, the contact surfaces 28 and 30 are formed by deforming the contact sections 14 and 16 to form mounds. However, any suitable contact surfaces could be provided by use of any suitable means. In an alternate embodiment, the special contact surfaces 28 and 30 need not be provided. In the embodiment shown, the top and bottom contact sections 14 and 16 are located at the diagonally shaped open area 20, at opposite ends 22 and 24, respectively. However, in an alternate embodiment, the top and bottom contact sections 14 and 16 need not be located at the top and bottom of the diagonally shaped open area 20. As can be seen best in FIG. 3, due to the general parallelogram shape of the main body section of blank 26 (see FIG. 5), the top of end 22 and the bottom of end 24 are spaced a greater distance from each other than the height of the main body section 12 at any single location. This allows the contact surfaces 28 and 30 to be the farthest two locations at the top and bottom of the contact 10 with the contact at rest.

Figure 2:
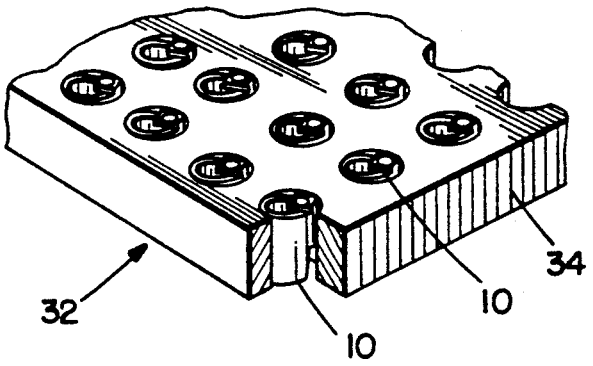
FIG. 2 is a partial schematic perspective view with a cut away section of an electrical connector incorporating the electrical spring contact shown in FIG. 1.
Figure 4:
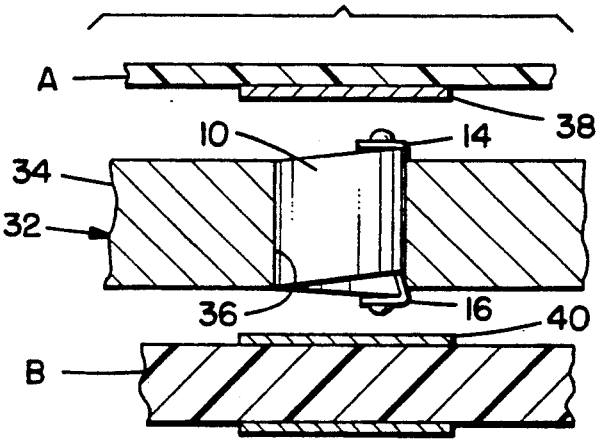
FIG. 4 is a partial schematic cross sectional view of the connector shown in FIG. 2 about to be used to electrically connect two parallel printed circuit boards.

Referring also to FIGS. 2 and 4, a connector 32 is shown having contacts 10 adapted to electrically connect two parallel printed circuit boards A and B. The connector 32 includes a housing 34 having a plurality of contact receiving apertures 36. The housing 34 can be comprised of dielectric material or, of metallic material with insulating sleeves (not shown) provided in apertures 36 that ar intended to transmit signals therethrough. A description of a metallic matrix block with insulating sleeves can be found in U.S. Pat. No. 4,961,709 which is incorporated by reference in its entirety. Although the connector 32 is being described as being used between two parallel printed circuit boards, the connector 32 can be used for connecting any suitable type of electrical or electronic components. The first printed circuit board A has contact traces 38 and the second printed circuit board B has contact traces 40 located in general registry with each other. The contacts 10 are intended to connect the traces 38 and 40 to each other, or a ground, with a relatively short path.

The connection between the boards A and B is merely made by sandwiching the connector 32 therebetween. The traces 38 and 40 contact the top and bottom contact sections 14 and 16 and, press the contact sections towards each other. This causes each of the contacts 10 to deform with the two ends 22 and 24 moving towards each other, thereby making the open area 20 smaller. In a preferred embodiment, the two ends 22 and 24 contact each other at a final deformation position such that a substantially straight and short path is provided between contact sections 14 and 16 and, greater stress is applied by the contact sections 14 and 16 against the traces 38 and 40. Also in the preferred embodiment, the two ends 22 and 24 not only contact each other, but also wipe each other to insure a good electrical contact therebetween. The substantially straight path between the contact sections 14 and 16 provides a shorter path than previously provided in the prior art as well as good top and bottom deflection of the contact 10 that is needed in a multi-contact parallel-type connector. In the embodiment shown, the steps or ridges 23 and 25 are provided to assure contact between the two ends 22 and 24 to thereby assure that a short path between the two ends is provided and, to enhance wipe action between the two ends for a good contact. The dual step stress between the contact 10 and circuit boards A and B of a first step where the contact is able to relatively easily deform due to open area 20, and a second step, when the contact is relatively harder to deform than the first step because of contact between ends 22 and 24, provides both good contact stress by contact 10 against traces 38 and 40 and, good deflectability of the contact 10.

Figure 5:
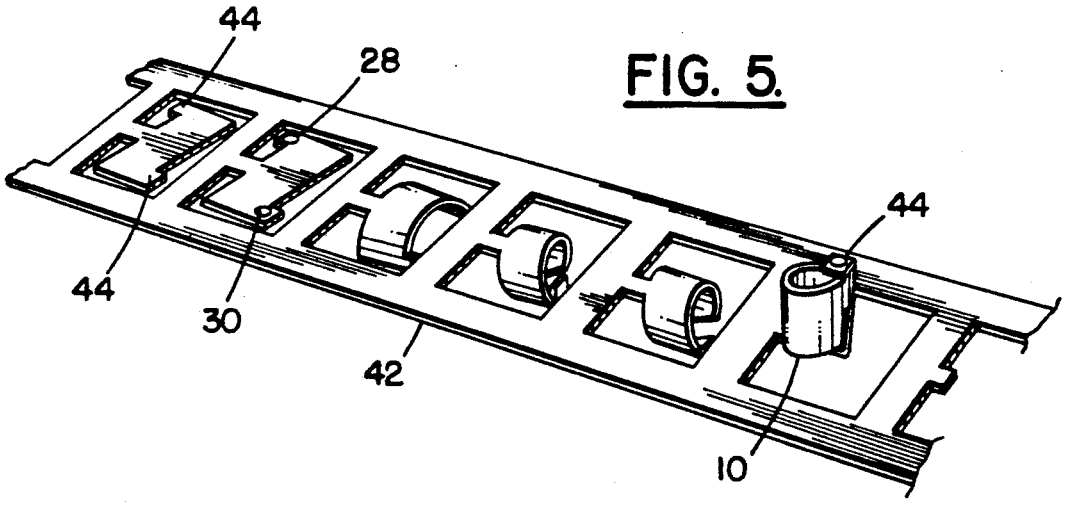
FIG. 5 is a schematic perspective view illustrating the manufacture of the contact shown in FIG. 1 from a sheet of metal.

Referring also to FIG. 5, there is shown a schematic perspective view of a strip or sheet 42 of metal that is undergoing a contact 10 formation process. The strip 42 is first cut to form a blank 26. The blank 26 has a main body with a general parallelogram shape and tabs 44. The contact surfaces 28 and 30 are formed at the tabs 44. A progressive die process then rolls or stamps the main body into an annular ring. The annular ring would then be bent up and inserted into one of the apertures 36. The annual ring preferably should be circumferentially compressed inside aperture 36 to thus frictionally hold the contact 10 in place. The tabs 44 are bent inward as shown. In an alternate embodiment, the tabs 44 could be bent outward to positively prevent the contact 10 from being inadvertently removed from the connector housing 34 and thus also form contact sections 14 and 16. Of course, a multi-row process could be used rather than the single row process shown.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical contact comprising:

a main body section having a general ring shape with a general diagonally shaped open area extending from a top of the main body section to a bottom of the main body section, the main body section being substantially uniformly solid except for its center and the general diagonally shaped open area;

a top contact section extending from the top of the main body section proximate the general diagonally shaped open area; and a bottom contact section extending from the bottom of the main body section proximate the general diagonally shaped open area, the top and bottom contact sections being adapted to electrically interconnect conductive regions of a pair of opposed circuit members.

2. A contact as in claim 1 wherein the main body section, the top contact section and the bottom contact section are comprised of a sheet of stamped metal.

3. A contact as in claim 1 wherein the top contact section is located generally opposite the bottom contact section with the diagonally shaped open area therebetween.

4. A contact as in claim 1 wherein the main body section is deformable such that the top contact section can move relative to the bottom contact section by means of two ends of the main body section along the diagonally shaped open area moving relative to each other.

5. A contact as in claim 1 wherein the contact sections each have a contact bump thereon.

6. A contact as in claim 1 wherein the main body section general ring shape is a single loop coil.

7. A contact as in claim 1 wherein the diagonally shaped open area extends along about 45° of the main body section circumference.

8. A contact as in claim 1 wherein the diagonally shaped open area is limited to less than 360° of a helical path.

9. An electrical connector comprising;

a housing having a plurality of contact receiving apertures extending therethrough; and contacts located in the contact receiving apertures, each of the contacts having a top contact section, a bottom contact section, and a main body section, the main body section having a general coil shape with a single loop, the bottom contact section extending from a first end of the single loop, the top contact section extending from a second opposite end of the single loop, and the two ends being adapted to contact each other when compressed, the top and bottom contact sections being adapted to electrically interconnect conductive regions of a pair of opposed circuit members located on opposite sides of the housing.

10. An electrical connector as in claim 9 wherein each contact has an open area between the two ends of the main body section.

11. An electrical connector as in claim 9 wherein the contacts each have a helical open area along less than 360° of their outer perimeter.

12. An electrical connector as in claim 9 wherein the contacts are circumferentially compressed when inserted in the contact receiving apertures to establish a friction hold of the contacts in the housing.

13. An electrical connector as in claim 9 wherein the main body section is longitudinally deformable to provide movement of the top and bottom contact sections relative to each other.

14. An electrical connector as in claim 10 wherein the open area is generally diagonally shaped.

15. An electrical connector as in claim 14 wherein at least one end of the main body section has a ridge for contacting the other end when the contact is compressed.

16. An electrical contact comprising:

a main body section having a general ring shape, the main body section being substantially solid except for its center and a helical open area extending between inside and outside of the main body section in a path of less than 360°, the main body section having a top end, a bottom end, and two side ends, the two side ends generally defining the helical open area and being adapted to contact each other when the top and bottom ends are compressed towards each other; and a contact section extending from each of the top and bottom ends, the contact sections being adapted to electrically contact conductive regions of a pair of opposed circuit members.

* * * * *